US007988477B1

(12) United States Patent
Zhu

(10) Patent No.: US 7,988,477 B1
(45) Date of Patent: Aug. 2, 2011

(54) ELECTRICAL CONNECTOR HAVING CONTACTS WITH MULTIPLE MATING PORTIONS IN DIFFERENT DIRECTION

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/911,744

(22) Filed: Oct. 26, 2010

(30) Foreign Application Priority Data

May 18, 2010 (CN) ..... 2010 2 0193495

(51) Int. Cl.
*H01R 13/28* (2006.01)
*H01R 25/00* (2006.01)

(52) U.S. Cl. ..... 439/290; 439/682

(58) Field of Classification Search ..... 439/660, 439/83, 78–80, 74, 682, 857, 290, 391, 291
See application file for complete search history.

(56) References Cited

U.S. PATENT DOCUMENTS 5,197,891 A 3/1993 Tanigawa et al.
7,033,194 B1 * 4/2006 Le Beau ..... 439/290
7,878,859 B2 * 2/2011 Zhu ..... 439/638
2004/0072473 A1 * 4/2004 Wu ..... 439/638

* cited by examiner

*Primary Examiner* — Javaid Nasri
(74) *Attorney, Agent, or Firm* — Wei Te Chung; Andrew C. Cheng; Ming Chieh Chang

(57) ABSTRACT

An electrical connector assembly includes a first connector and a second connector. The first connector has a first mating face and a number of first contacts retained therein. Each first contact comprises a first mating board and a second mating board vertically protruding from the first mating face. The second connector is mated with the first connector and comprises a second housing with a second mating face confronting with the first mating face and second contacts. The second housing defines corresponding mating slots to receive the first contacts. Each of the second contacts comprises two pairs of holding arms which are arranged non-parallel to each other and each pair of the holding arm elastically perpendicularly projects in the mating slot thereby clipping one of the first mating board and the second mating board of the first contacts.

14 Claims, 6 Drawing Sheets

ELECTRICAL CONNECTOR HAVING CONTACTS WITH MULTIPLE MATING PORTIONS IN DIFFERENT DIRECTION

BACKGROUND OF THE INVENTION

1. Field of the Invention

The present invention relates to an electrical connector assembly, and particularly to an electrical connector assembly having contacts with multiple mating portions for securing two mated connectors thereof together.

2. Description of the Prior Art

It is well known that a board-to-board connector assembly is widely used for connecting two printed circuit boards (PCBs) together and includes a first connector mounted on a first PCB and a second connector mounted on a second PCB and electrically connected with the first connector. The connector assembly is often fixed together with contact engagement for ensuring a reliable connection between the first connector and the second connector, thereby ensuring a reliable electrical connection and mating strength.

An electrical connector disclosed in U.S. Pat. No. 5,197,891 issued to AMP Inc. on Mar. 30, 1993 includes a plastic housing containing first electrical contacts therein. A pair of resilient holding arms is formed on each contact and fit through an aperture on the housing. A second contact (not shown) for mating with the first contact is inserted into the aperture and between the pair of holding arms so as to achieve electrical connection. However, this type of contact can only ensure the engaging force in clip direction such that an offset or dislocation of the contact assembly would happen in a direction vertically to the clip direction when there is a shocking by external force and it will cause contact's damages and unstable electrical connection that we do not want to see.

In view of the above, an improved electrical connector assembly that overcomes the above-mentioned disadvantages is desired.

SUMMARY OF THE INVENTION

Accordingly, an object of the present invention is to provide an electrical connector assembly which has improved alignment and positioning structure.

To fulfill the above-mentioned object, an electrical connector assembly includes a first connector and a second connector. The first connector has a first mating face and a number of first contacts retained therein. Each first contact comprises a first mating board and a second mating board vertically protruding from the first mating face. The second connector is mated with the first connector and comprises a second housing with a second mating face confronting with the first mating face and second contacts. The second housing defines corresponding mating slots to receive the first contacts. Each of the second contacts comprises two pairs of holding arms which are arranged non-parallel to each other and each pair of the holding arm elastically perpendicularly projects in the mating slot thereby clipping one of the first mating board and the second mating board of the first contacts.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Reference to FIGS. 1 to 6, an electrical connector assembly includes a first connector 1 mounted on a first PCB (not shown) and a mated second connector 2 mounted on a second PCB (not shown).

Figure 3:
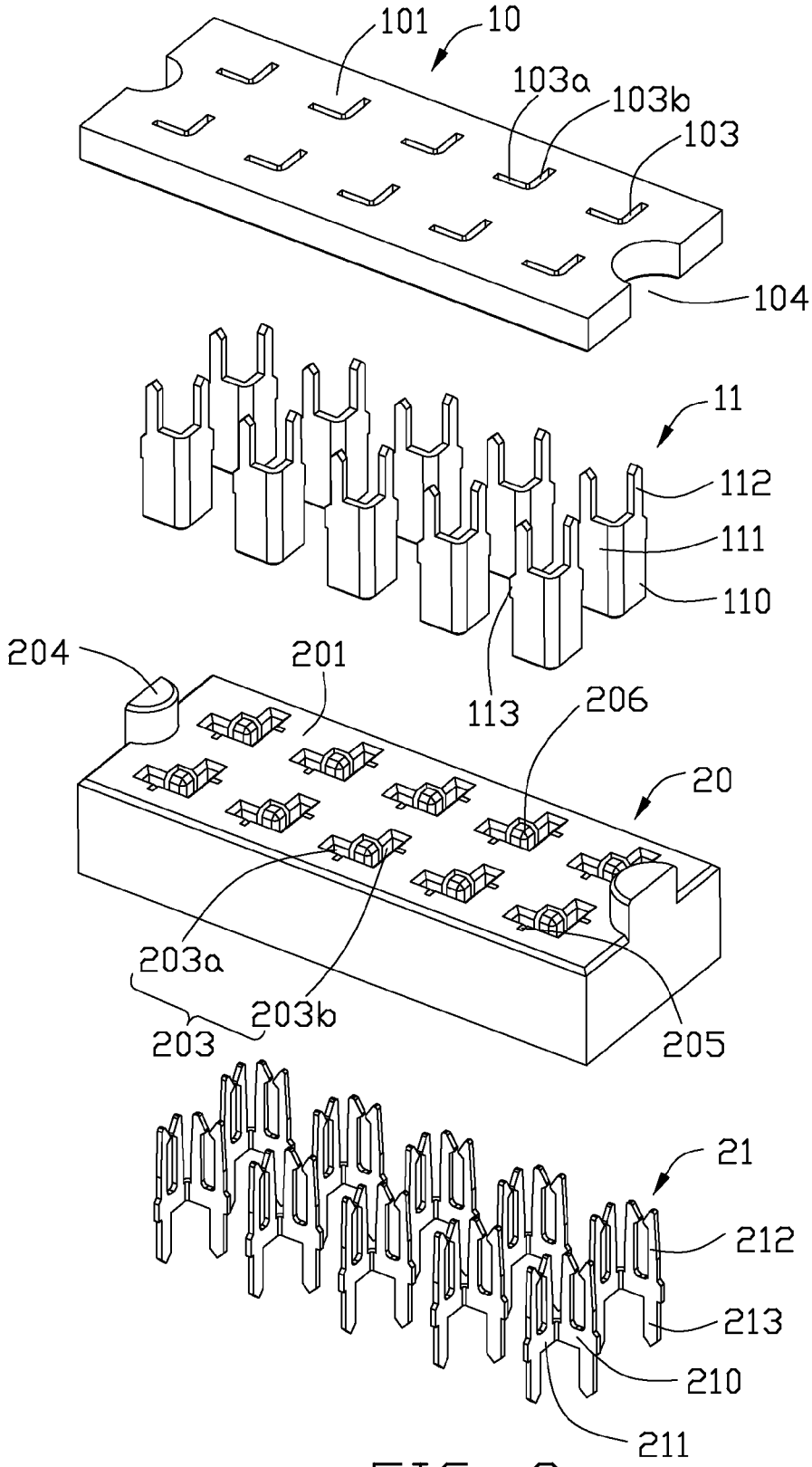
FIG. 3 is an exploded, perspective view of the first and second connectors 1.
Figure 4:
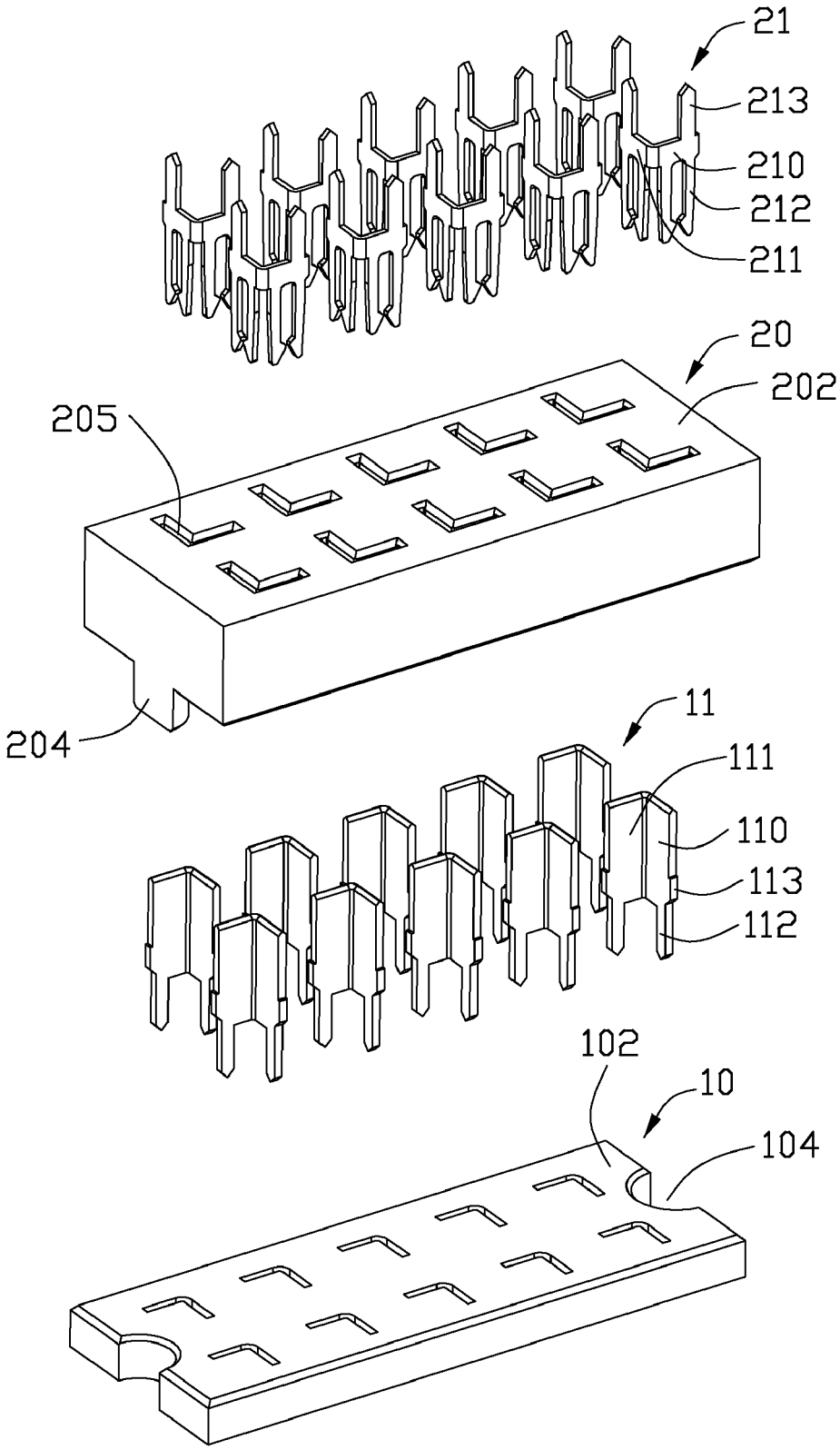
FIG. 4 is another exploded, perspective view of the first and second connectors.

Referring to FIGS. 3 and 4, the first connector 1 defines opposite first mounting face 101 and first mating face 102 and comprises an elongated first housing 10 extending in a base direction A (labeled in FIG. 2) which is parallel to the first mating face 102 and two rows of first contacts 11 arranged along said base direction and received in a corresponding number of first receiving slots 103 formed on the housing 10. Each of said first receiving slots 103 has L-shaped cross section on the first mounting face with symmetrical sides and extends through both of the first mounting face 101 and the first mating face 102. Each first receiving slot 103 comprises a first section 103*a* and a second section 103*b* vertically communicating with the first section 103*a*.

Each of said first contacts 11 comprises first and second mating boards 110,111 perpendicularly to each other, two first mounting tails 112 extending on one edge of the first and second mating board 110,111 respectively, and retaining portions 113 such as barbs formed at lateral sides of the first and second mating board 110,111 adjacent to the mounting tails. The perpendicular first and second mating boards 110,111 of the first contact 11 are coincide with the L-shaped first receiving slots 103. The first mounting tails 112 protrude from the first mounting face 101 and the first and second mating boards 110,111 are received through the first receiving slots 103 and protrude from the first mating face 102. Two semicircular positioning notches 104 are formed on opposite ends of the first housing 10 along the base direction A.

Referring to FIGS. 3 and 4, the second connector 2 defines opposite second mating face 201 and second mounting face 202 and comprises a second elongated housing 20 extending in the base direction A and two rows of second contacts 21 arranged along said base direction and received in a corresponding number of mating slots 203. The mating slots 203 are formed by communicating first and second mating sections 203*a*, 203*b* perpendicular to each other, which construct with an L-shaped cross section. The mating slots run through the second mating. Two pairs of second receiving slots 205 are defined at the two opposite sides of the first section and the second section of each mating slots, which communicates with the second mating slots 203.

Each of said second contacts 21 comprises first and second retaining boards 210,211 perpendicularly to each other, two second mounting tails 213 extending on one edge of the first and second retaining board 210,211 respectively and two pairs of first holding arms 212 extending from another edge of the first and second retaining board 210,211 respectively. The first and second retaining boards 210,211 are received and retained in the second receiving slots 205 and the pairs of the holding arms elastically projection into the mating slot, thereby mating spaces formed between holding arms 212 so as to clip the inserted first and second mating board 110,111 of the first contact 11 to the second mating slots. The pairs of the holding arms do not project beyond the second mating face 201. Two positioning posts 204 are formed on opposite ends of the second housing 20 along the base direction A, which protrude from the second mating face 201 for mating with the positioning slot 104 of the first housing 10. The corner of each L-shaped second mating slot 203 further forms a guiding post 206.

Figure 1:
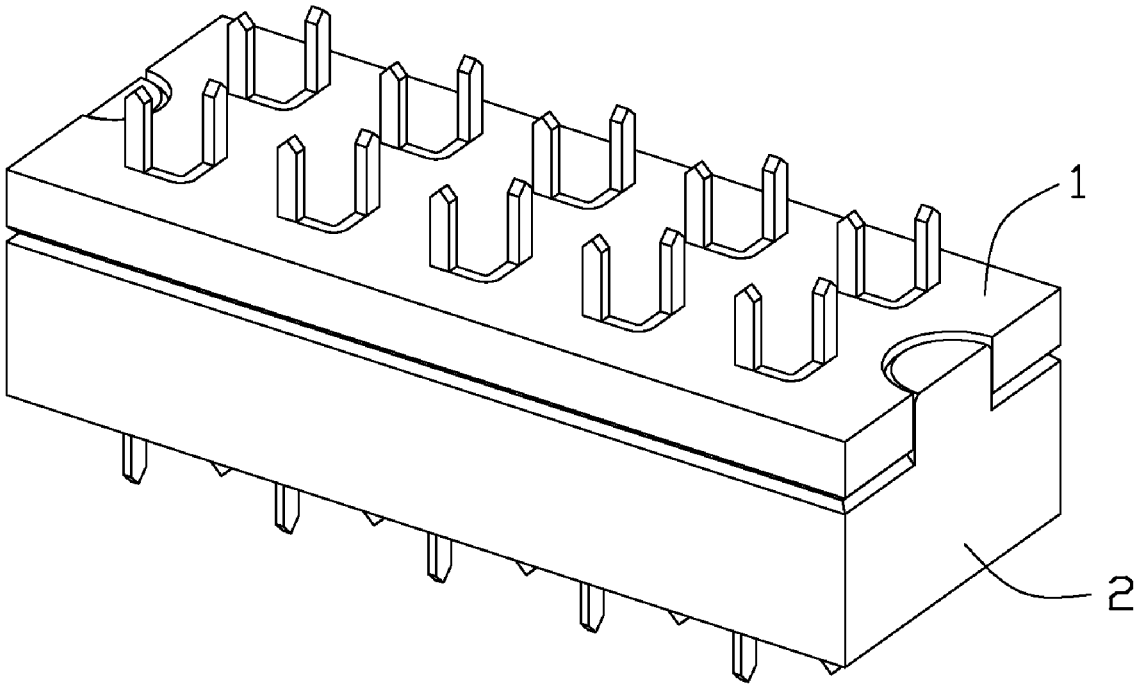
FIG. 1 is an assembled, perspective view of an electrical connector assembly of an embodiment of the present invention.
Figure 2:
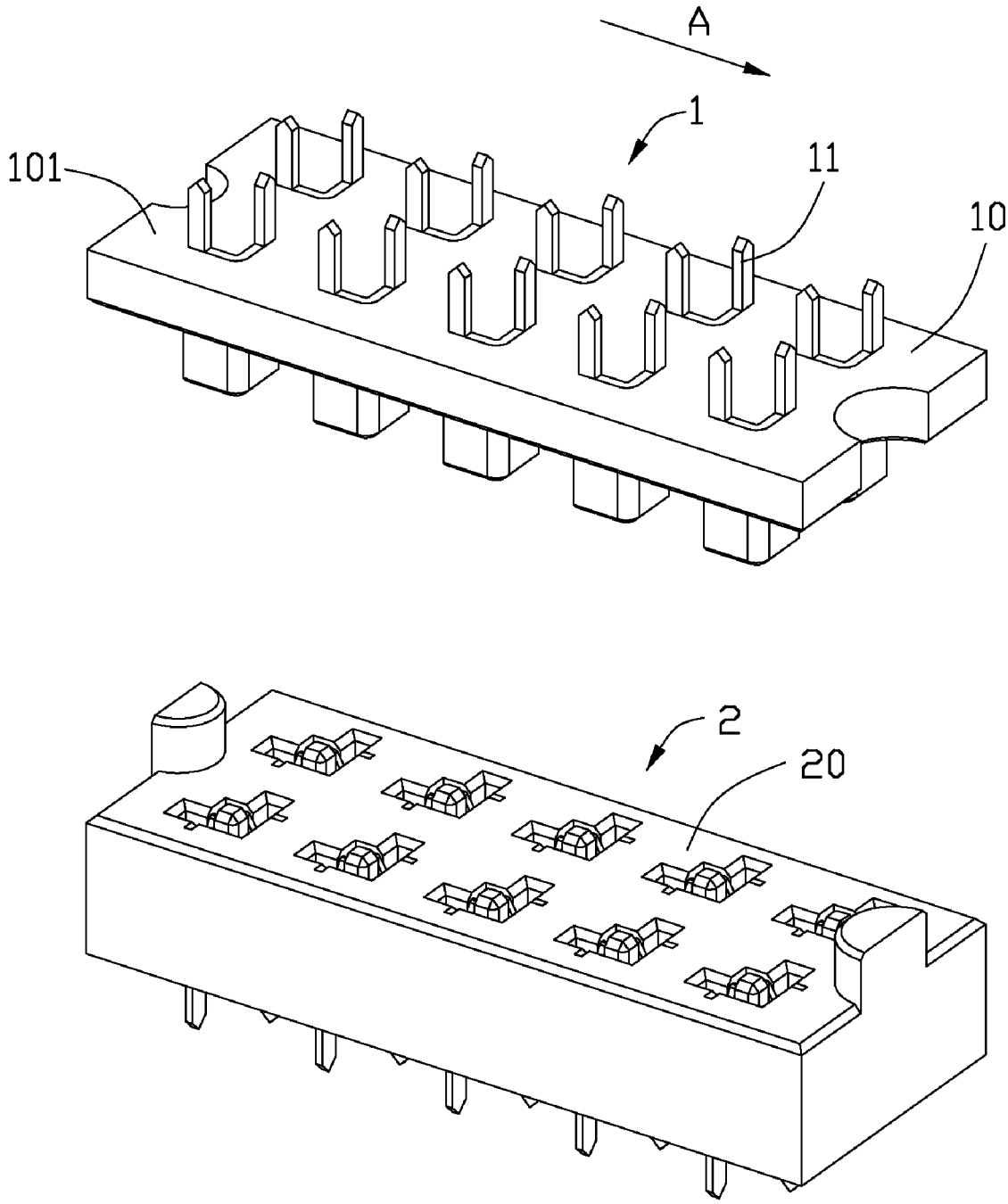
FIG. 2 is a perspective view of first and second connectors as shown in FIG. 1.
Figure 5:
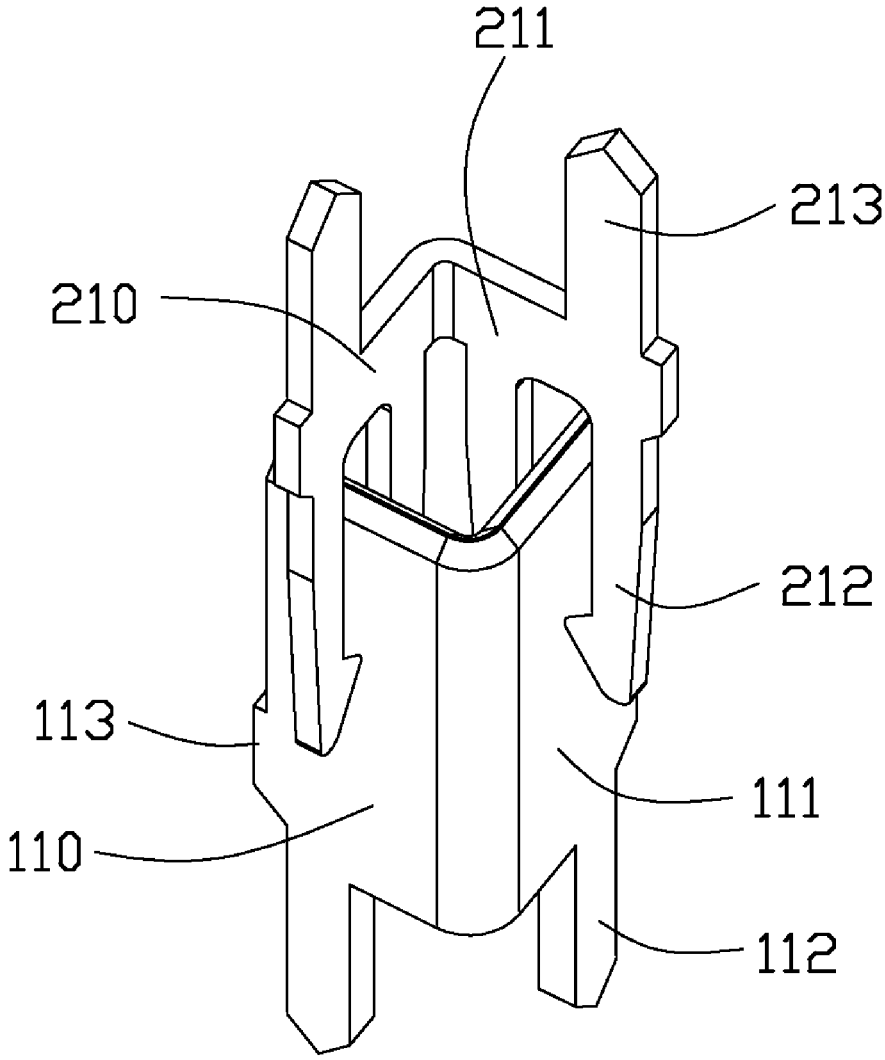
FIG. 5 is an assembled, perspective view of a contact assembly as shown in FIG. 4.
Figure 6:
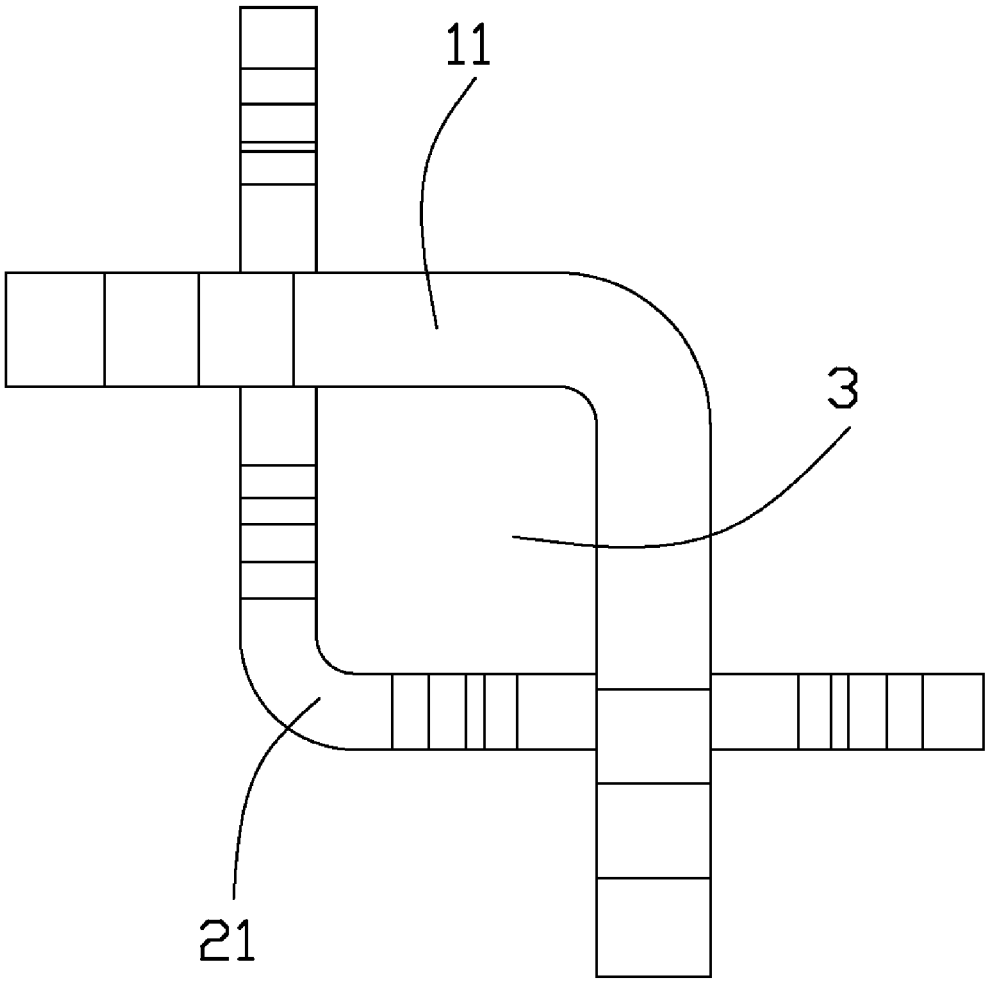
FIG. 6 is a top view of the contact assembly as shown in FIG. 5.

Referring to FIGS. 1, 5 and 6, the first and second mating board 110,111 of each first contact of the first connector 10 are received in one corresponding second mating slot 203 of the second connector 20 and clipped by two pairs of the holding arms 212 to complete the mechanically and electrically connection. The L-shaped first and second contacts 11, 21 mate in a reverse type, thereby forming a closed space 3, such as square, parallelogram or any other type with multiple clips along different directions is allowed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a first connector defining a first mating face and comprising a first housing with a plurality of first contacts retained thereto, each of the first contacts comprising a first mating board and a second mating board vertically protruding from the first mating face; and a second connector mated with the first connector and comprising a second housing with a plurality of second contacts retained therein, said second housing defining a second mating face confronting with the first mating face, the second housing defines corresponding mating slots to receive the first contacts; wherein each of the second contacts comprises two pairs of holding arms which are arranged non-parallel to each other, each pair of the holding arms elastically perpendicularly projects in the mating slot thereby clipping one of the first mating board and the second mating board of the first contacts.

2. The electrical connector assembly as claimed in claim 1, wherein the first mating board and the second mating board of each first contact perpendicularly connect each other.

3. The electrical connector assembly as claimed in claim 2, wherein the first and second mating boards extend one mounting tail respectively.

4. The electrical connector assembly as claimed in claim 2, wherein each of the second contact comprises two perpendicular retaining boards and the two pairs of the holding arm extending from the two retaining boards respectively.

5. The electrical connector assembly as claimed in claim 4, wherein the two retaining boards extend one mounting tail respectively.

6. The electrical connector assembly as claimed in claim 5, wherein the two pairs of holding arms have a same size.

7. An electrical connector for mating with a complementary connector, comprising:

an insulating housing defining opposite mating face and mounting face and comprising mating slots through the mating face, each slot being un-interrupt and comprising a first section and a second section joining with each other with a first angle;

a plurality of contacts received in the corresponding mating slots, respectively, each of said contacts defining a first mating segment and a second mating segment joining with each other with a second angle essentially identical with the first angle; where said housing further defines plural pairs of receiving slots under condition that each pair of receiving slots are joined with each other while respectively intersecting with the corresponding first section and the second section of the corresponding mating slot; where a plurality of terminals are disposed in the corresponding receiving slots and electrically and mechanically connected with the corresponding contacts, respectively, under condition that the contacts belong to the complementary connector while the terminals are retained to the housing; where in each contact and the corresponding terminal, one includes at least one mating board and the other includes at least a pair of holding arms sandwiching said mating board therebetween; where each contact includes a pair of mating boards respectively on the first mating segments and the second mating segments, and each corresponding terminal includes two pairs of holding arms clipping the corresponding mating boards, respectively.

8. The electrical connector as claimed in claim 7, wherein each pair of receiving slots intersect with the first section and second section of the corresponding mating slot at a right angle, respectively.

9. The electrical connector as claimed in claim 8, wherein each pair of receiving slots intersect with the first section and the second section of the corresponding mating slot with therebetween a guiding post extending upwardly and rooted from the mounting face and surrounded by both the pair of receiving slots and the first section and the second section of the mating slot.

10. The electrical connector as claimed in claim 7, wherein the receiving slots extend through both the mating face and the mounting face while the mating slot extends through only the mating face.

11. The electrical connector as claimed in claim 7, wherein the angle between the first section and the second section is 90 degree.

12. An electrical connector assembly comprising:

a first connector including:

a first insulative housing enclosing at least a first contact defining a first L-shaped cross-section in a top view;

a second connector including:

a second insulative housing enclosing at least a second contact defining a second L-shaped cross-section in the top view; wherein when the first connector and the second connector are mated with each other, said first contact and said second contact are mechanically and electrically connected with each other defining at least a closed type square in the top view; where said first contact and said second contact are intermingled and intersected with each other; where the first contact defines at least a mating board and the second contact defines at least a pair of holding arms sandwiching said mating board therebetween.

13. The electrical connector assembly as claimed in claim 12, wherein the second housing defines a mating slot extending through thereof a mating face with an L-shaped cross-section in a top view, including a first section and a second section, to receive the first contact which are inserted into the second housing through the mating face.

14. The electrical connector assembly as claimed in claim 13, wherein the second housing further defines a pair of receiving slots respectively intersected with the first section and the second section of the mating slot under condition that said pair of receiving slots extend through at least one of said mating face and an opposite mounting face to receive the second contact.

* * * * *